United States Patent [19]

Kubik

[11] 4,227,346

[45] Oct. 14, 1980

[54] MODULAR CASE SECTION AND FRAME SECTION FOR LIFTING AND/OR SLIDING WINDOWS OR DOORS

[75] Inventor: Hans Kubik, Bodenwöhr, Fed. Rep. of Germany

[73] Assignee: Golde GmbH, Geretsried, Fed. Rep. of Germany

[21] Appl. No.: 905,202

[22] Filed: May 12, 1978

[30] Foreign Application Priority Data

Aug. 12, 1977 [DE] Fed. Rep. of Germany ... 7725150[U]

[51] Int. Cl.[2] ..... E05D 13/02

[52] U.S. Cl. ..... 49/425; 49/501; 49/504

[58] Field of Search ..... 49/425, 504, 406, 458, 49/404, 501; 52/206, 207, 235

[56] References Cited

U.S. PATENT DOCUMENTS

| | | | |
|---|---|---|---|
| 2,927,354 | 3/1960 | Lauer | 49/501 X |
| 3,159,883 | 12/1964 | Tucker | 49/425 |
| 3,324,597 | 6/1967 | Rich | 49/425 X |
| 3,751,868 | 8/1973 | Mascioletti | 52/235 X |
| 3,859,754 | 1/1975 | Budich et al. | 49/425 |
| 3,978,617 | 9/1976 | Eventoff | 49/425 |

FOREIGN PATENT DOCUMENTS

| | | | |
|---|---|---|---|
| 2517009 | 11/1975 | Fed. Rep. of Germany | 49/425 |

*Primary Examiner*—Philip C. Kannan

*Attorney, Agent, or Firm*—Silverman, Cass & Singer, Ltd.

[57] ABSTRACT

Modular case and frame sections for assembly into a self-supporting case and frame for lifting and/or sliding doors and/or windows, the case section being a hollow generally rectangular element having a pair of main chambers and a smaller chamber therebetween, first recess means on said element and guide means received therewithin. Said frame is defined by a pair of hollow side parts and a hollow bridging part, second and third recess means defined by said side and bridging parts, said second recess means being larger in cross section than the first recess means and capable of receiving connection means, closing means and carriage means therein.

16 Claims, 12 Drawing Figures

MODULAR CASE SECTION AND FRAME SECTION FOR LIFTING AND/OR SLIDING WINDOWS OR DOORS

BACKGROUND OF THE INVENTION

This invention relates to a case section and a frame section preferably plastic for lifting and/or sliding closures such as windows or doors.

Plastic sections per se are known but have the disadvantage in that considerable working operations were necessary whereby the entire arrangement became expensive both during manufacture and installation.

Additionally, case sections are known which are formed of aluminum and are plastic coated. These sections were not only expensive to produce but also very expensive to install.

Accordingly, there is a need to provide case and frame sections which are fabricated of plastic and show great stability yet enable facile and cost-saving installation.

It would be desirous also to provide case and frame sections with include self-contained recesses within which are received the operating mechanisms required for the installation so as to enable much reduction in assembly time. Further advantage is to be gained by providing case and frame sections formed of stable, modular type elements which can be produced and assembled quickly and easily, again materially reducing cost without loss of functional advantage.

SUMMARY OF THE INVENTION

Accordingly, there is provided a frame section and a case section preferably formed of plastic, each being a self-supporting unit with interior chambers. The case section is provided with recesses on its circumference for holding roll shutter sections and a guide section; and the frame section has recesses on its circumference for holding sealing strips, a connecting section operable together with the guide section, a running carriage and a closing mechanism.

In a further development of the invention, metal elements can be inserted in the chambers of the frame section and of the case section further to strengthen the resulting arrangement.

The case section can comprise a pair of large chambers and a small rectangular chamber located in between the two large chambers. A crosspiece is arranged on each of the front sides of the two large chambers. The crosspiece which is arranged on one front side can have a recess on each of the two sides and the crosspiece which is arranged on the other front side can have a recess on only one side. A crosspiece is provided with recesses on both sides and has a closed chamber in the center zone. The crosspiece provided with one recess forms two closed chambers; a closed surface with one rectangular side of the adjacent large chamber results here.

The small center chamber of the case section of the invention can be less high than the adjacent large chambers and can be provided with a crosspiece reaching to the level of the lateral surfaces of the large chambers; here one crosspiece forms a closed surface with one lateral surface of a closed chamber so that good cleaning possibility results.

Further according to the invention, the recesses in the crosspiece of the two large chambers are provided with an interior spaced half-round groove, the recesses on the crosspiece of the small chambers being provided with a shoulder. The guide section has a plane surface having adjacent side parts and one side part ends in a shoulder adapted to engage in the shoulder of the case section whereby to provide a simple connection possibility between the guide section and the case section so that the functionally correct installation of the guide sections in the case section is assured.

The frame section can be essentially U-shaped where the two side parts and the center part have chambers closed in themselves and where the connection section, the running carriage or the closing mechanism can be placed in the opening formed between the side parts to create a section which as formed meets all possibilities of installation found to occur in practice.

The front side of each of the two side parts is provided with a recess for holding sealing strips or a covering section. One side part has a flange protruding over the center part and the other side part has an approximately T-shaped crosspiece which is arranged in the center zone and in which a strip can be placed. The flange of one side part and the strip can support a glass pane arranged therebetween whereby assembly of the glass pane on the frame section is facilitated.

The two side parts and the center part each is provided with a common chamber into which a U-shaped metal support element can be placed where one side part has one chamber and the other side part has four further chambers. Because of this arrangement, there results a considerable increase of the stability of the frame section. Two crosspieces are located in the center part of the common chamber, spaced at a distance, from each other and the opposite support surfaces, sufficient to hold the metal strip whereby to enable faultless placement of the strip within the frame section. An interior recess is formed in each of the two side parts of the frame at the upper zone thereof capable of holding a brush strip.

There is provided a connection section having a rectangular cross section, said section capable of being placed within the recess of the U-shaped frame section. The connection section has, in the front side, a crosspiece which is capable of being placed in the U-shaped groove of the guide section. The rectangular cross section of said connection section is subdivided into several chambers, the crosspiece also being designed as a chamber. In this manner the connection section is provided with substantial strength.

In accordance with the invention, the metal elements capable of being inserted in the large chambers of the case section, can be hollow, rectangular sections and the metal element insertable in the metal chamber can be a rectangular strip.

Figure 1:
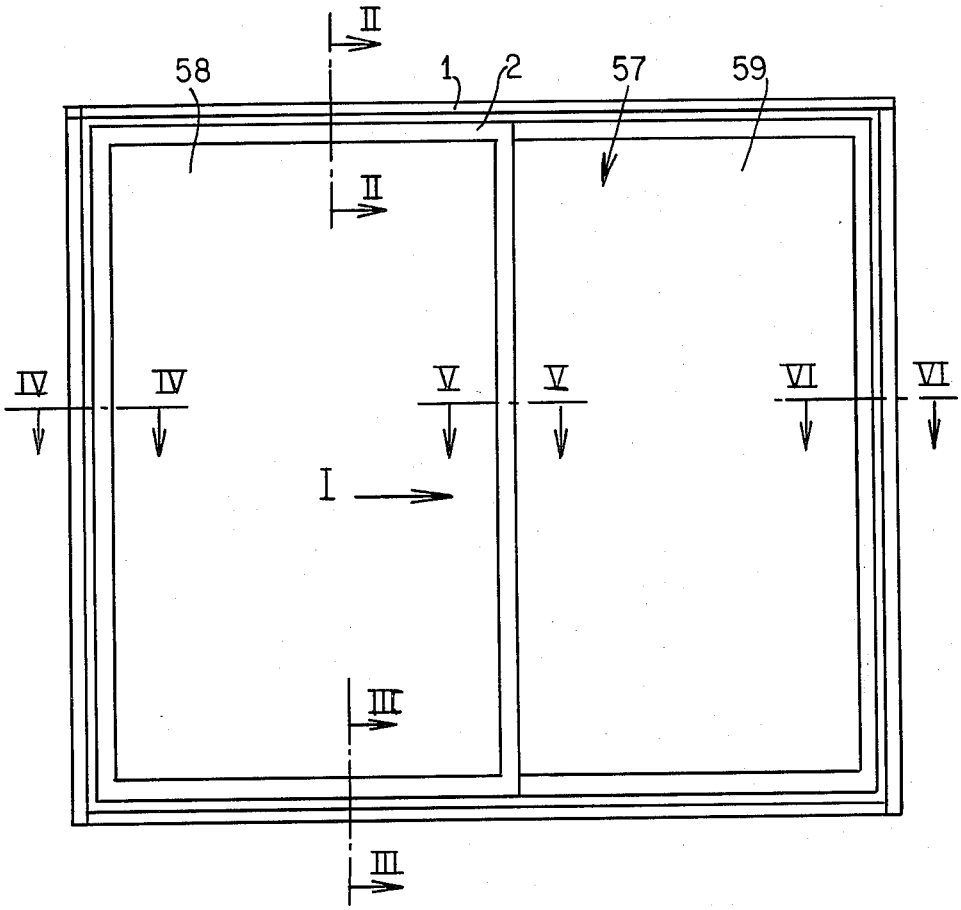
FIG. 1 is a front elevational view of the lifting-sliding door assembled using the sections constructed in accordance with the invention.
Figure 7:
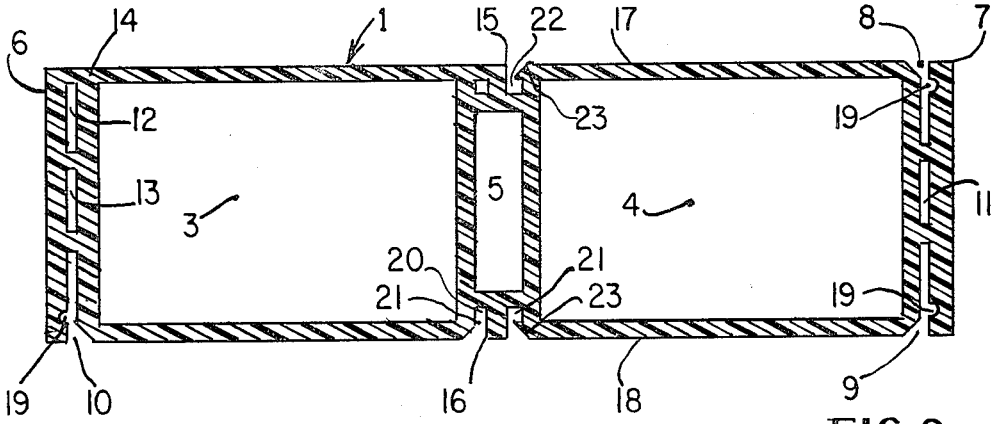
FIG. 7 is a sectional view of the case section constructed in accordance with the herein invention.
Figure 12:
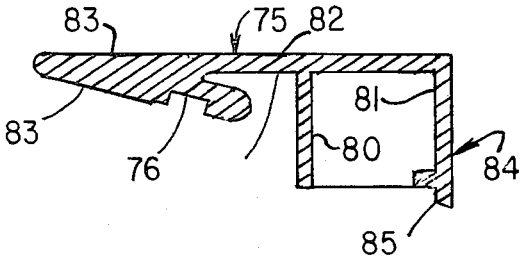
FIG. 12 is asectional view of the center closure section constructed in accordance with the herein invention.

Before describing the use and assembly of the individual sections according to the invention into the lifting-sliding door of FIG. 1, the individual sections illustrated respectively in FIGS. 7 and 12 first shall be described.

In FIG. 7, the case section 1 is shown in cross section. As can be seen, the case section is of rectangular configuration wherein two large chambers 3 and 4 and a small chamber 5 therebetween are formed. Crosspieces 6 and 7 are arranged on the outwardly facing sides of the two larger chambers 3 and 4, respectively. The crosspiece 7 is provided with recesses 8 and 9 whereas the crosspiece 6 along left chamber 3 merely has one recess 10. The rectangular side 14 of the large chamber 3 is integral with crosspiece 6. A half-round groove 19 is formed in inwardly facing surfaces of crosspieces 6 and 7 adjacent each of the recesses 8,9 and 10. A pair of chambers 12 and 13 are defined between the crosspiece 6 and the outer wall of chamber 3 and a single chamber 11 is defined between crosspiece 7 and the outer wall of chamber 4, said chamber 11 being in the center zone between recesses 8 and 9. The small chamber 5 is much smaller than the two large chambers 3,4 and has two crosspieces 15 and 16 between spaced opposite faces 17 and 18 of the large chambers 3 and 4.

The crosspiece 16 is spaced from the face 18 of the chambers 3 and 4 by the recesses 20 and 21. The crosspiece 15 is separated from the face 17 of chamber 4 merely by the recess 22. The rectangular side 14 of the large chamber 3 thus extends not only to the crosspiece 6 but also to the crosspiece 15 so that the imperforate surface is extended into this zone.

Figure 8:
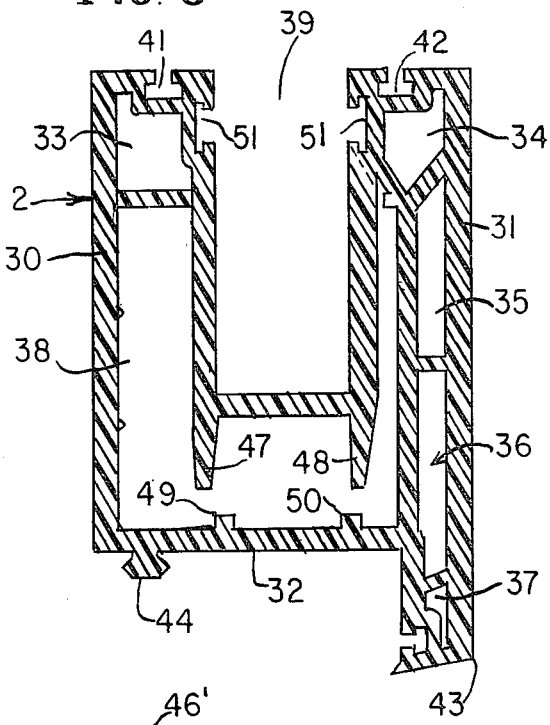
FIG. 8 is a sectional view of the frame section constructed in accordance with the herein invention.

In FIG. 8, the frame section 2 is illustrated in detail. Frame section 2 is essentially U-shaped and includes two side parts 30 and 31 and a center or bridging wall 32. The side parts 30 and 31, and the bridging part 32 have interior closed chambers 33, 34, 35, 36, 37 and 38. The chamber 38 is defined within and extends over the two side parts 30 and 31 as well as over the bridging part 32. A pair of crosspieces 47 and 48 are disposed interior of chamber 38 in the vicinity of bridging part 32. The crosspieces 47 and 48 are directed toward supporting bar surfaces 49 and 50.

A recess 39 is defined between the pair of side parts 30 and 31. The upper ends of the two side parts 30 and 31 also are provided with recesses 41 and 42, respectively, which can serve, for instance, to hold a rubber strip or a cover section. A pair of recesses 51 and 52 are formed in those portions of side parts 30 and 31 which defined recess 39, said recesses 51 being capable of holding brush strips, for example.

Looking further at FIG. 8, the side part 31 of the U-shaped frame section 2 is extended beyond the bridging part 32 to define outwardly directed flange 43. The side part 30 has a T-bar 44 running parallel to flange 43.

Figure 9:
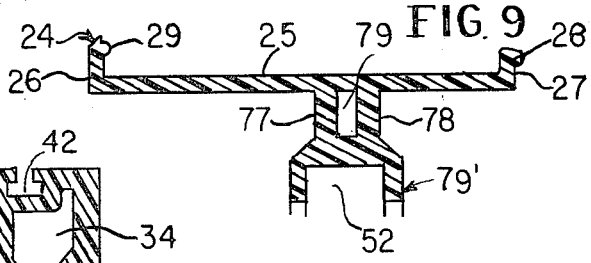
FIG. 9 is a sectional view of the guide section constructed in accordance with the herein invention.

In FIG. 9, the guide section 24 is shown in a cross section. Guide section 24 has a plane surface 25 with upstanding flanges 26 and 27. The flange 26 has a shoulder 29 along its free end and the side flange 27 has an enlargement 28 along its free end. The enlargement 28 is formed of size and configuration to enable it to be engaged in the half-round groove 19 of crosspiece 7 or 6. Accordingly, the shoulder 29 of flange 26 is formed of size and configuration to enable it to reach behind the shoulder 23 of the recesses 20,21 or 22 in the vicinity of the small chamber 5 of the case section 1.

Thereby it is possible to slide in the guide section 24 in such a way that the enlargement 28 places itself in the half-round groove 19 and that the shoulder 29 engages behind the shoulder 23 of the case section. This assures secure fastening of the guide section 24 on the case section 1 while simultaneously there is provided assurance that a functionally incorrect attachment of the guide section 24 on the case section 1 is avoided. The planar wall 25 of the guide section 24 has a pair of depending flanges 77,78. The free ends of flanges 77,78 are unitary with U-shaped length 79' defining groove 52.

Figure 10:
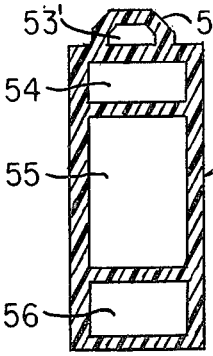
FIG. 10 is a sectional view of the connection section constructed in accordance with the herein invention.

In FIG. 10, the connection section 40 is shown in a cross section. Connection section 40 has a rectangular cross section and has chamber 54,55 and 56 defined therein. A U-shaped crosspiece 53 is provided along connection section 40 at the upper portion thereof to define a chamber 53'. The width of the connection section 40 is selected to enable placement thereof in recess 39 of the frame section 2.

Figure 11:
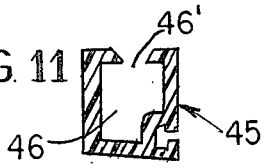
FIG. 11 is a sectional view of the bar section constructed in accordance with the herein invention.

In FIG. 11, a hollow retainer bar 45 is shown in a cross section. Retainer bar 45 has a chamber 46 having an opening 46'. The opening 46' enables the bar 45 to be slidably engaged with the T-bar 44 of the frame section 2 to fasten said bar 45 on frame section 2.

A center closure 75 is illustrated in cross section in FIG. 12. Center closure 75 preferably is formed of aluminum and is of generally triangular cross sectional configuration. Closure 75 includes a plate 82 having a depending thickened formation 83 along one edge and a hollow bottom opening formation 84 defined by depending walls 80 and 81. A recess 26 or groove 76 extends along thickened formation 83. By means of the section arrangement provided by the invention, it is now possible to develop, for instance, a lifting-sliding door as it is shown in FIGS. 1 to 6 developed by assembly of the elements illustrated in FIGS. 7 to 12.

The lifting-sliding door according to FIG. 1 has a movable part 58 and a stationary part 59. Thereby it is possible, for instance, to move the movable part 58 to the right in the direction of the arrow I so that said movable part covers the stationary part 59 whereby the left side of the lifting-sliding door is opened. As can be seen, sections 1 and 2 are used.

Figure 2:
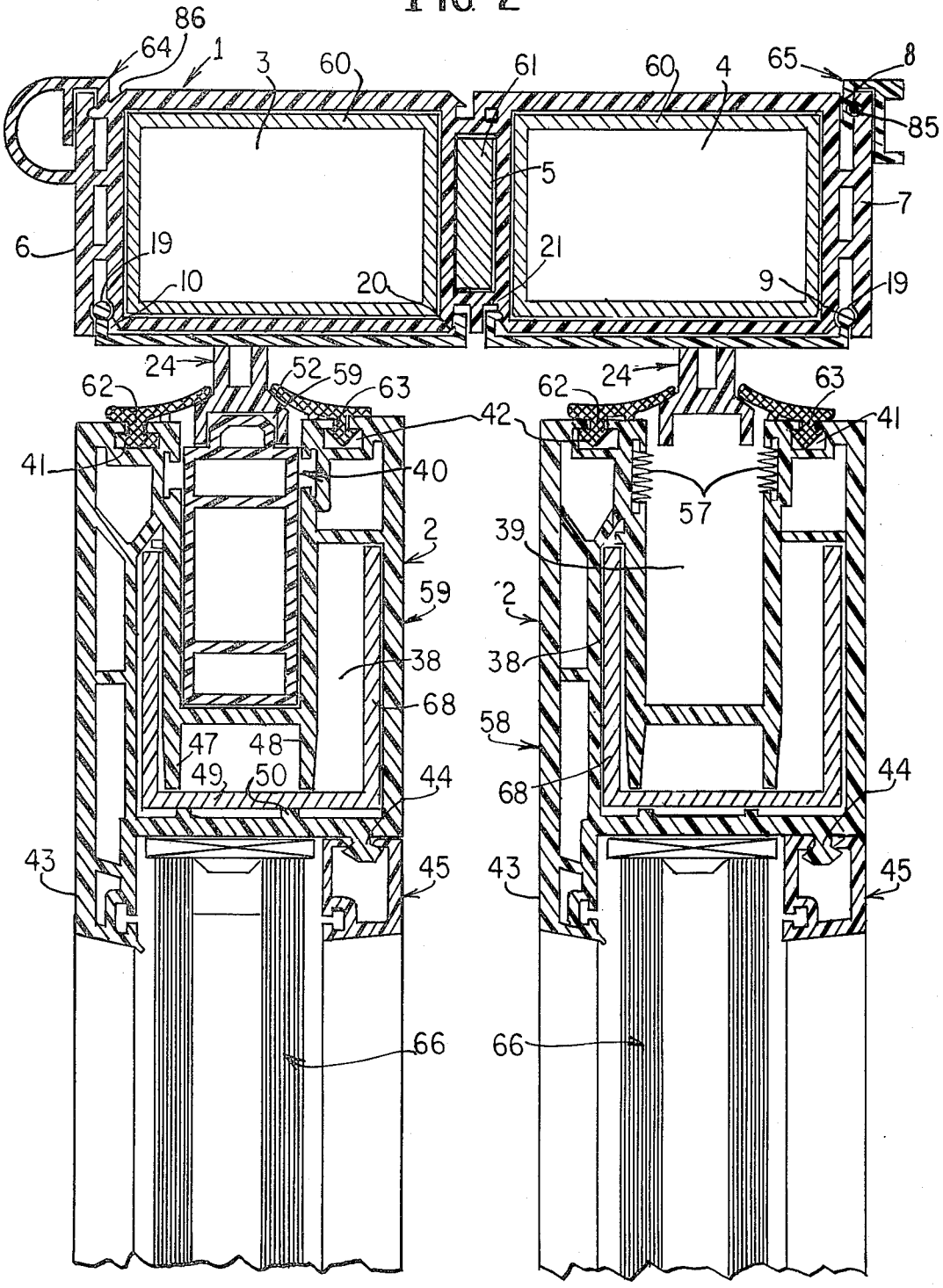
FIG. 2 is a sectional view taken along lines II—II of FIG. 1 and viewed in the indicated direction.

In FIG. 2, the case section 1 is connected securely to the building. Hollow rectangular sections 60 made of metal can be arranged interior of the two chambers in order to strengthen the case ssection. A rectangular strip 61 can be placed interior of the small chamber 5. The crosspiece 6 of the chamber 3 is slit open along its longitudinal length in the upper zone and thereby coextensive with chamber 12 to define recess 86 into which a roll shutter traverse housing 64 can be slid. An elongate cover bar 65 can be engaged on the crosspiece 7, flange 85 being engaged in recess 8. Two guide sections 24 are engaged respectively in recesses 10, 20, 21 and 9. As described hereinabove, the flanges 26 and 27 of guide member 24 are engaged in said recesses with the half-round groove 19 receiving the enlargement 28 of the guide section 24 and the shoulder 29 engaged behind the shoulder 23.

Referring to FIG. 2, there also are provided frame sections 2 where the connection section 40 is placed in the recess 39 of that frame section 2 defining the stationary part 59. This connection section 40 operates together with its crosspiece 53 and the groove 52 of the guide section 24.

Rubber gaskets or packings 62 and 63 are inserted in the recesses 41 and 42 of said frame sections 2. A metal strip 68 is inserted within chambers 38 of the frame sections 2 whereby to increase the stability of the frame section assembly. The thickness of the metal strip 68 here is selected such that the strip is placed faultlessly between the two crosspieces 47 and 48 as well as between the support surfaces 49 and 50. Bar 45 is slidably engaged over the T-bar 44. It is possible to place an insulating glass pane 66 each time between the flange 43 and the bar 45.

As illustrated in FIG. 2, one frame section 2 forms the stationary part 59 of the lifting-sliding door whereas the other frame section 2 forms the movable part 58 thereof. Brush packings 67 are inserted in the recesses 51 formed within recess 39 of section 2 used on the movable part 58 of said lifting-sliding door.

Figure 3:
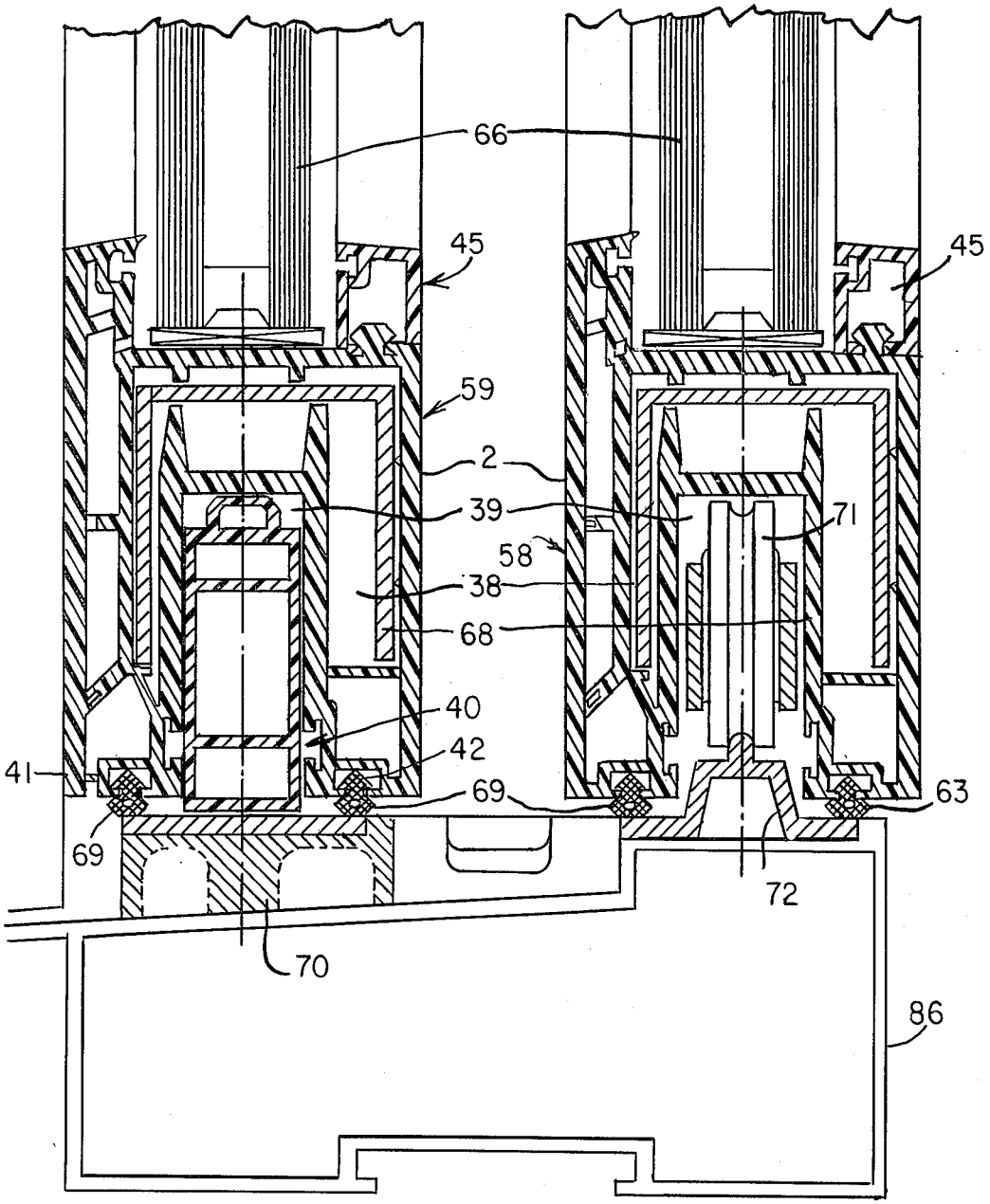
FIG. 3 is a sectional view taken along lines III—III of FIG. 1 and viewed in the indicated direction.

In FIG. 3, the two frame sections 2 can be recognized which form the movable part 58 of the lifting-sliding door as well as the stationary part 59 of this door. The frame section 2, which forms the stationary part 59, is supported on a support bar 70 by way of the connecting section 40. Gaskets or packings 69, which produce perfect sealing, are inserted in the recesses 41 and 42 of the frame section 2. Bar 70 is seated on threshold 86.

The frame section 2 of movable part 58 has a running carriage 71 disposed within recess 39 thereof, said running carriage 71 adapted to roll over rails 72 seated on the threshold 86. Thereby it is possible to move the movable part 58 of the lifting-sliding door illustrated in FIG. 1 in the direction of arrow I. The two frame sections 2 each have again a metal strip 68 within the large chamber 38. In FIG. 3, there can again be recognized the retaining bar 45 and the insulating glass pane 66.

Figure 4:
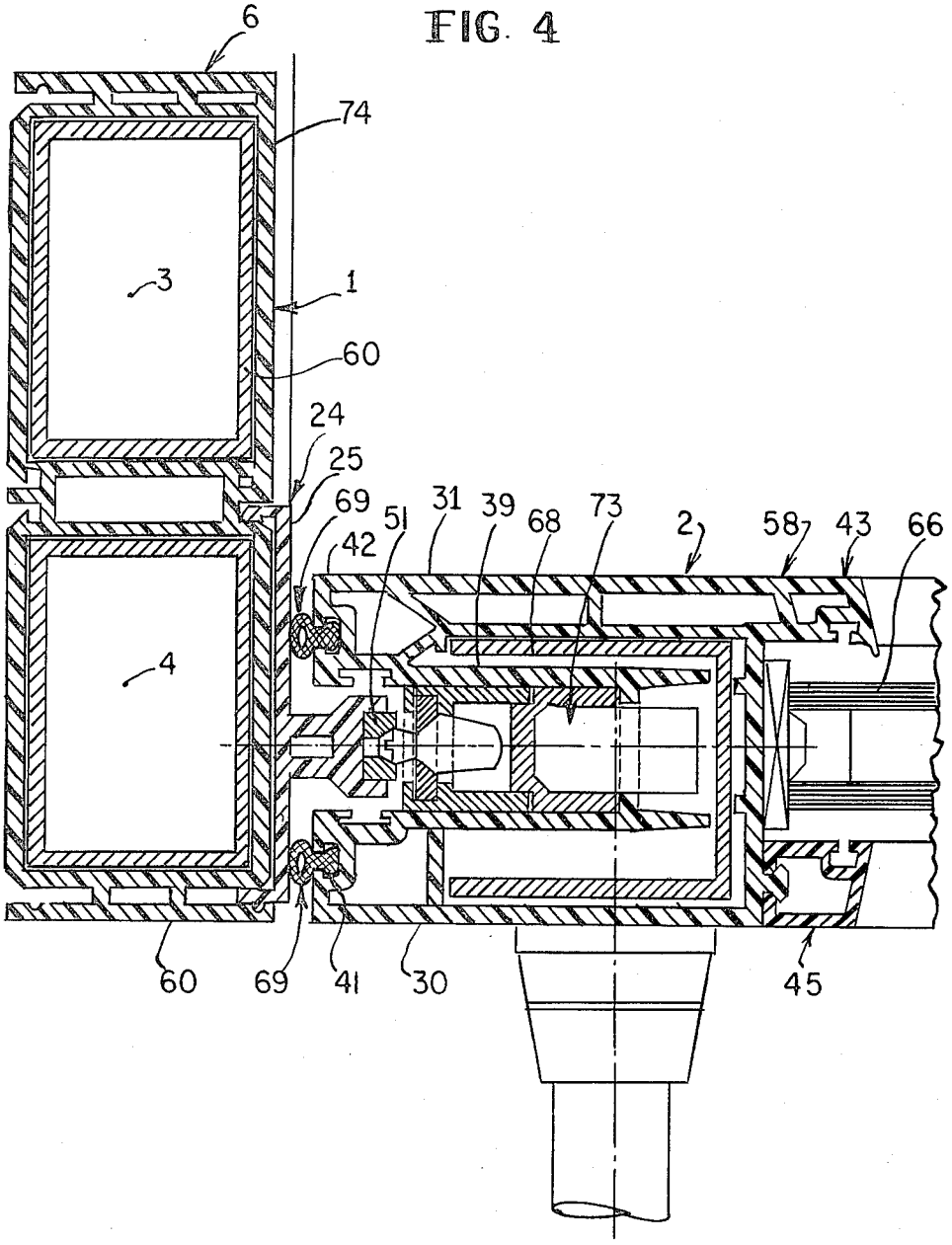
FIG. 4 is a sectional view taken along lines IV—IV of FIG. 1 and viewed in the indicated direction.

Referring to FIG. 4, section 1 is illustrated with rectangular sections 60 within chambers 3 and 4 for increased strength. The crosspiece 6 of frame section 1 according to FIG. 4 forms in cooperation with the face 14 of the large chamber 3 a smooth rectangular surface. Cleaning of this area is facilitated because there are no protruding edges. The guide section 24 is engaged on face 11 bordering chamber 4 with the flanges 26,27 within recesses 22,8 zone of the other large chamber 4. Parts of the closing mechanism 73, operable in concert, are arranged in the groove 52 of the guide section 24 as well as in the recess 39 of the frame section 2, with the major portions of said mechanism 73 positioned mainly in the recess 39. The chamber 38 of the section 2 includes metal strip 68 for strengthening purposes. The frame section 2 in FIG. 4 is employed on the movable part 58 of the lifting-sliding door. The insulating glass pane 66 is held by the flange 43 as well as by the retainer bar 45. Rubber gaskets 69 again are arranged in the recesses 41 and 42 carried by side parts 30 and 31. The rubber gaskets act again on the plane surface 25 of the guide section 24 and thereby produce perfect sealing.

Figure 5:
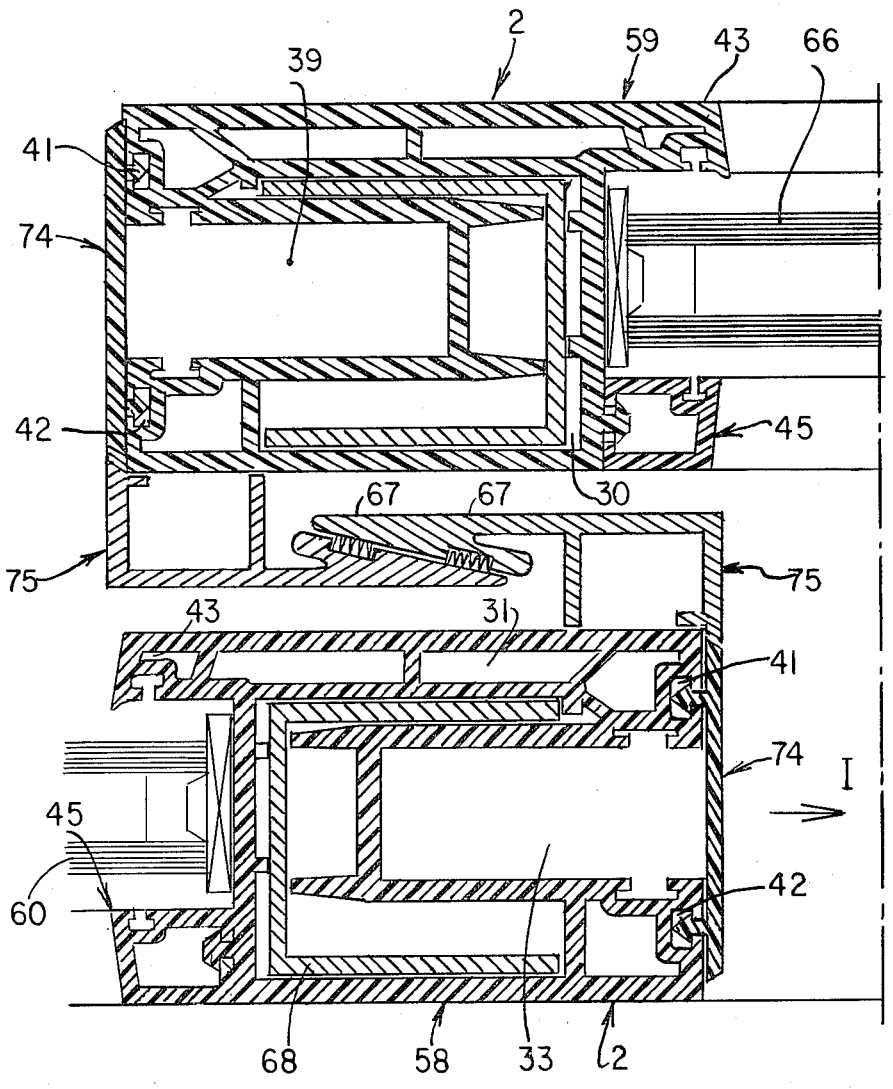
FIG. 5 is a sectional view taken along lines V—V of FIG. 1 and viewed in the indicated direction.

In FIG. 5, each of the two parts 58,59 are illustrated as formed by a frame section 2. As visible in FIG. 5, a cover section 74 engages in the recesses 41 and 42 of the respective frame section 2 and thereby covers the recess 39 of the frame section 2. On one side part of movable part 58, there is fastened the center closure bar 75 which is shown in detail in FIG. 12. A brush packing 67 is arranged in the recess 76.

On the stationary part 59, a center closure 75 also is fastened on the side part 30 of the frame section 2, where this center closure 75 has also a brush packing 67. When the lifting-sliding door is opened, the movable part 58 can be moved in the direction of arrow I so that the two brush packings 67 are not in engagement with the opposite parts. Vice versa, when the lifting-sliding door is closed, the two brush packings 67 bear on the opposite surfaces and thereby produce perfect sealing. The respective insulating glass panes 66 again are placed between the retainer bar 45 and the flange 43.

Figure 6:
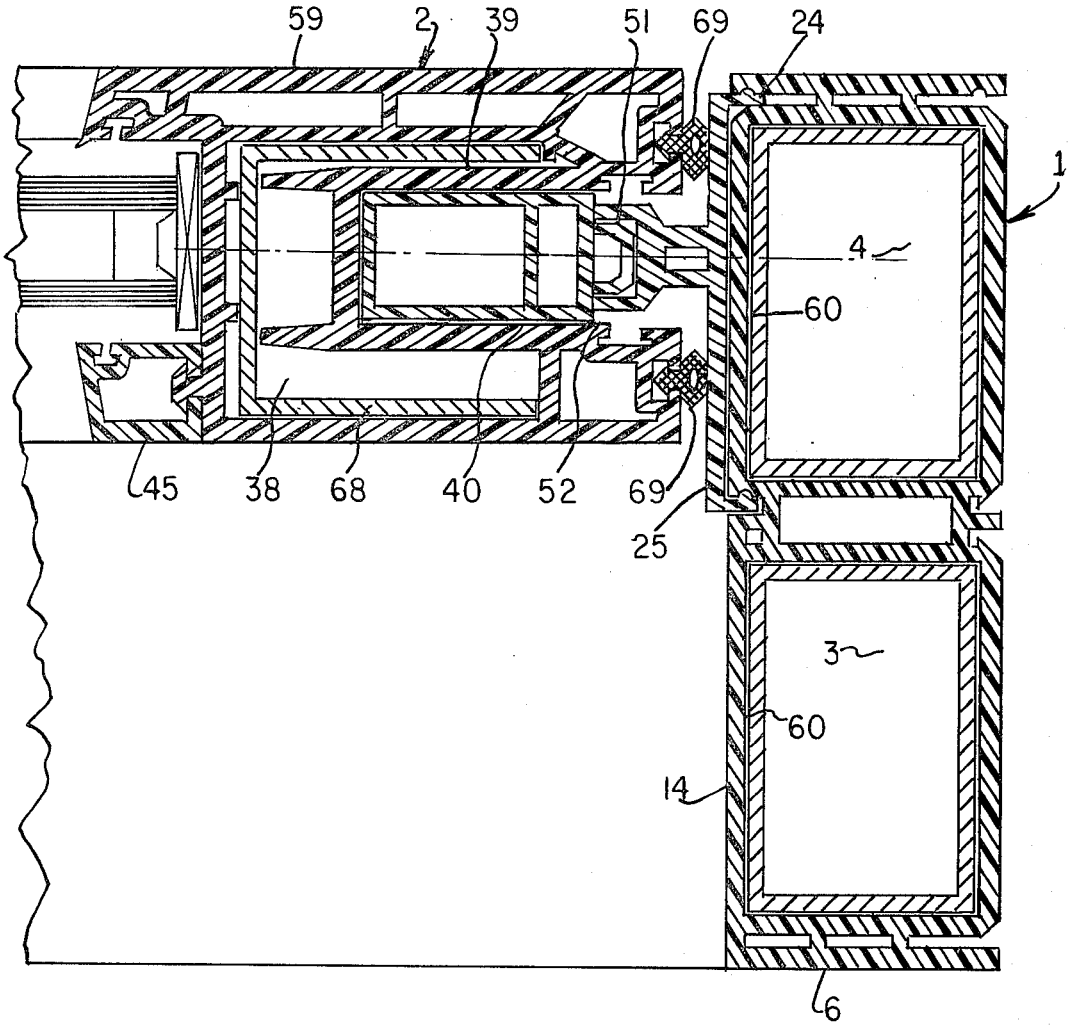
FIG. 6 is a sectional view taken along lines VI—VI of FIG. 1 and viewed in the indicated direction.

In FIG. 6, the case section 1 has the rectangular sections 60 within chambers 3 and 4 for strengthening purposes. The face 14 of the case section 1 forms together with the adjacent face of the large chamber 3 again an easily cleanable surface. On the case section 1, there is again fastened a guide section 24 with the crosspiece 53 of connection section 40 engaged in groove 52 thereof. This connection section 40 is placed in the recess of that frame section 2 forming the stationary part 59 of the lifting-sliding door 39. Rubber gaskets 69 are placed in recesses 41 and 42 of frame section 2 and bear against the underside of the plane surface 25 of the guide section 24.

A metal strip 68 is gain arranged in the chamber 38 in order to strengthen the frame section 2.

Altogether there results thereby that, in a simple manner, the development of, for instance, a lifting-sliding door is possible by the section arrangements illustrated in FIGS. 7 to 12, where said lifting-sliding door is very sturdy, can be installed easily and has a versatile applicability. Beyond that, it is easily possible to clean the surfaces which are exposed.

Preferably, the frame and case sections as well as the secondary sections illustrated in FIGS. 9–12 are extrusions.

I claim:

1. In a lifting and/or sliding closure assembly such as windows and/or doors of the type which include case and frame sections formed of modular elongate first and second hollow elements, the first elements arrangeable end to end within a building opening to define a casement construction and said second elements arrangeable end to end to define a sash construction receivable within said casement construction for defining said closure, a running carriage mechanism and a closing mechanism, and means operable to couple the sash construction within the casement construction, the invention comprising each of said sections having plural enclosed chambers therein, said first and second elements each having circumferential walls defining a generally rectangular cross-sectional configuration, a plurality of elongate guide sections, first flange means formed on said guide sections and first recess means formed along the length of one of said circumferential walls of said first element receiving said first flange means coupling said guide sections to said first element, the running carriage mechanism being received within a selected one of said second elements, the closing mechanism being received within a selected one of said second elements, an elongate hollow connection section coupled to said guide section and outwardly opening channel defining means formed on said guide section along the length thereof receiving a portion of said connection section, second recess means formed in said second element of size and configuration to receive a selected one of said connection section, a running carriage mechanism and closing mechanism recpectively therein, said second recess means being of conforming cross-sectional configuration to the cross-sectional configuration of said connection section, and plural groove means formed in said second elongate elements along the length thereof and plural sealing members seated within said grooves and extending outward therefrom.

2. The structure as claimed in claim 1 wherein said guide sections include a plate and said first flange means comprise a pair of upstanding longitudinally extending flanges on one surface thereof along the edges thereof, one of said flanges terminating in a first enlarged formation and the other of said flanges terminating in a second enlarged formation, said formations engaged with said first recess means.

3. The structure as claimed in claim 1 wherein said connection section has a rectangular cross section and said channel defining means formed on said guide section comprises a U-shaped grooved formation capable of receiving said portion of said connection section.

4. The structure as claimed in claim 1 wherein elongate metal elements are disposed within the said enclosed chambers.

5. The structure as claimed in claim 4 in which the metal elements seated in the large chambers of the first element are of hollow rectangular configuration and a metal strip of rectangular cross section is seated within said smaller chamber.

6. The structure as claimed in claim 1 wherein said first element includes a pair of main chambers and an intermediate chamber of reduced cross section therebetween, crosspiece means coextensive with and coupled to a selected pair of opposite ones of said circumferential walls of said first elements, said crosspiece means having opposite longitudinal edges and being spaced from said walls along their edges to define said first recess means.

7. The structure as claimed in claim 6 and said first recess means being defined between the main chamber defining circumferential wall portions of said first element and outwardly extending flange means disposed therein coextensive therewith and including an end surface integral and coplanar with one of said chamber defining portions of said first element.

8. The structure as claimed in claim 6 in which said crosspiece means comprise a first crosspiece having opposite longitudinal edges, and a second crosspiece having opposite longitudinal edges, one of said latter mentioned edges being unitary with said adjacent circumferential wall and the other of said latter mentioned edges being spaced from said adjacent circumferential wall whereby to define said first recess means coextensive therewith.

9. The structure as claimed in claim 8 wherein said second crosspiece defines a pair of closed chambers.

10. The structure as claimed in claim 8 wherein said first crosspiece and its adjacent circumferential wall defines an enclosed chamber intermediate the first recess means defined therebetween, and one edge of said second crosspiece is integral with an adjacent circumferential wall.

11. The structure as claimed in claim 1 in which said second elements each comprise a generally elongate member having a pair of hollow side portions and a hollow bridging portion defining a chambered U-shaped cross-sectional construction and said second recess means defined between said side portions.

12. The structure as claimed in claim 11 and elongate metal strip members seated within said chambers.

13. The structure as claimed in claim 11 in which said plural groove means are formed in each of said side parts of said second elements, cover means and a selected one of said sealing members and said cover means seated therein.

14. The structure as claimed in claim 13 wherein an outwardly protruding flange is formed on one of said side portions and a generally T-shaped crosspiece is formed on the other side portion, a retainer bar and means thereon for coupling said retainer bar to the said generally T-shaped crosspiece, said flange and retainer bar capable of supporting a glass pane therebetween.

15. The structure as claimed in claim 11 and elongate metal strip members seated within said chambers and means integral with said element for supporting said metal strips therein.

16. The structure as claimed in claim 15 and means defining a plurality of individual chambers within said connection section.

* * * * *